US005829627A

United States Patent [19]

Martindale

[11] Patent Number: 5,829,627

[45] Date of Patent: Nov. 3, 1998

[54] PORTABLE FOOD SERVICE DEVICE FOR YOUNG CHILDREN

[75] Inventor: Richard E. Martindale, Clinton, Conn.

[73] Assignee: Loren E. Watrous, North Branford, Conn.; A part interest

[21] Appl. No.: 909,455

[22] Filed: Aug. 11, 1997

[51] Int. Cl.[6] ..... B65D 6/04

[52] U.S. Cl. ..... 220/666; 206/522; 206/562; 108/43

[58] Field of Search ..... 220/574; 206/522, 206/562; 108/43

[56] References Cited

U.S. PATENT DOCUMENTS

| | | | |
|---|---|---|---|
| 2,650,698 | 9/1953 | Castner | 220/483 |
| 4,044,867 | 8/1977 | Fisher | 206/522 |
| 4,858,755 | 8/1989 | Kuivanen | 206/522 |
| 5,005,702 | 4/1991 | Davis et al. | 206/522 |
| 5,134,930 | 8/1992 | Mei-Hwa | 206/522 |
| 5,217,131 | 6/1993 | Andrews | 206/522 |
| 5,484,081 | 1/1996 | Jahn | 220/483 |
| 5,570,788 | 11/1996 | Batsford | 206/522 |

*Primary Examiner*—Joseph M. Moy
*Attorney, Agent, or Firm*—Robert H. Montgomery

[57] ABSTRACT

A portable food serving device for young children which comprises a tubular member of flexible material in a generally U-shape having spaced apart legs and a back portion joining the leg portions with a flexible sheet attached to the bottoms of said leg and back portions which defines a food receiving portion. The tubular member is inflatable and deflatable by means of a valve member. Attachment members are provided on the bottom of the device for attachment to a table surface. When defated the device may be folded and placed in a pouch for portability or storage.

4 Claims, 2 Drawing Sheets

PORTABLE FOOD SERVICE DEVICE FOR YOUNG CHILDREN

FIELD OF THE INVENTION

This invention relates to food service devices for young children, particularly those who normally are fed in so-called high chairs and are not yet skilled in the use of eating utensils.

BACKGROUND OF THE INVENTION

Young children usually are not adept in the use of eating utensils, such as knives, forks and spoons, and generally use thier fingers when not fed by someone else.

This has been recoginized by the provision of containment barriers for foods when a youg child is eating. For example, U.S. Pat. No. 1,135,269—Dudley discloses a a high chair tray cover of generally U-shape configuration which has upstanding flanges around all outside edges to eliminate throwing, wiping or spreading by a young child of food from the tray. For a similar purpose U.S. Pat. No. 2,807,312—Florian discloses a snap-on barrier for the tray of a high chair.

These devices appear to be well suited for the meal of a young child at home, but are limited to home use.

However, at the present time it is very common for parents to take young children out to have meals with them. Many restuarants provide high chairs for young children, however, this will seat the child away from the parents and any other persons present. Alternatively a restaurant may provide a booster seat for a young child. Then the child will be presented its food on a plate and will probably sweep or otherwise move its food all over the table.

Accordingly, the present invention provides a new and improved portable food service device for young children which may be used at home or when the child is taken to a restuarant for a meal. It may be used to provide a sanitary surface for finger food, or may be used to receive a food serving device such as a dish.

An object of this invention is to provide a new and improved food service device for young children which is easily transported.

Another object of this invention is to provide a food service device for youg children which is inflatable for use and which is deflatable after use for ease of transportation.

A further object of this invention is to provide a food service device for youg childrfen of the type thus far described which may be easily cleaned and is easily sanitized.

A still further object of this invention is to provide a food service device for young children of the type thus far describe which will contain and confine any food spillage and prevent spreadage of food.

SUMMARY OF THE INVENTION

Briefly stated, the invention, in one form thereof, comprises a tubular member formed of flexible material of generally U-shape having spaced apart leg portions joined by a back portion. A flexible sheet is attached to the leg and back portions and extends therebetween to define a food service area upon which a plate or other finger food may be placed. The tubular member includes a valving member which permits the tublar member to be inflated and deflated. Attachment means in the form of suction cups are on the bottom of the tubular member to permit the device to be secured to a table surface. When the decice is inflated and secured to a table surface, it presents an area for food placement with the tubular member forming a barrier against spread of food from the food placement area.

When no longer in use, the tubular member is deflated by opening the valving member, expelling air therefrom then placing the deflated member in a carrying pouch for transport or storage after it has been cleaned.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

DETAILED DESCRIPTION OF THE DRAWINGS

DESCRIPTION OF PREFERRED EMBODIMENTS OF INVENTION

Figure 1:
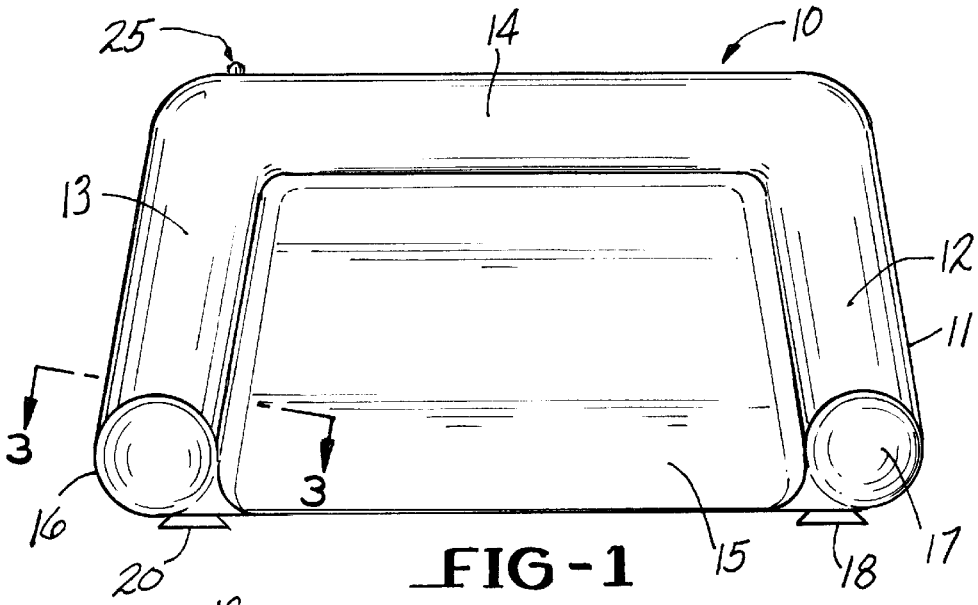
FIG. 1 is a top view of a device embodying the invention in perspective.

As shown in FIG. 1 , a food service device 10 embodying the invention comprises an inflated tubular member 11 of generally U-shape having opposed legs 12 and 13 with a connecting back portion 14. Extending between the legs 11 and 12 and back portion 14 is what is termed a service portion 15 in the form of a sheet of material, hereinafter described.

Tubular member 11 in one form of construction is formed of sections of an air impervious sheet material which sections thereof may be joined by heat sealing or adhesive and/or both. Examples of such materials are vynil, rubber, or any other sheet materials well known to those skilled in the art of fabrication of articles with flexible sheet materials.

The ends of legs 11 and 12 are closed with end pieces 16 and 17, respectively, to provide the air impervious U-shaped tubular member 11. Member 11 is inflatable and deflatable as hereinafter described.

Figure 2:
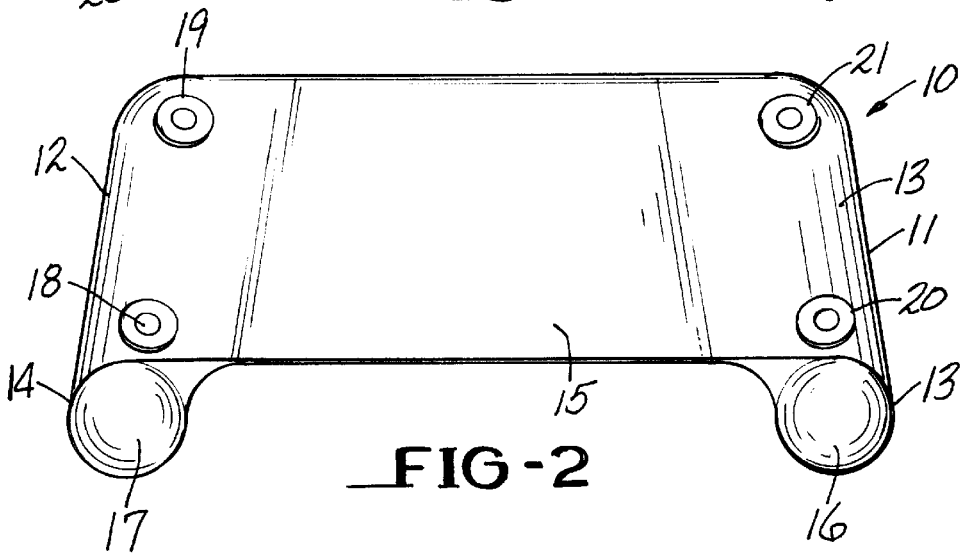
FIG. 2 is a bottom view of a device embodying the invention, also in perspective.

As shown in FIG. 2, a plurality of attachment means in the form of suction cups are attached to the bottom of member 11. Cups 18 and 19 are attached to leg 12 and cups 21 and 22 are attached to leg 13. Alternately, only three suction cups may be used, one attached to each of legs 12 and 13 and one on back portion 14.

Figure 3:
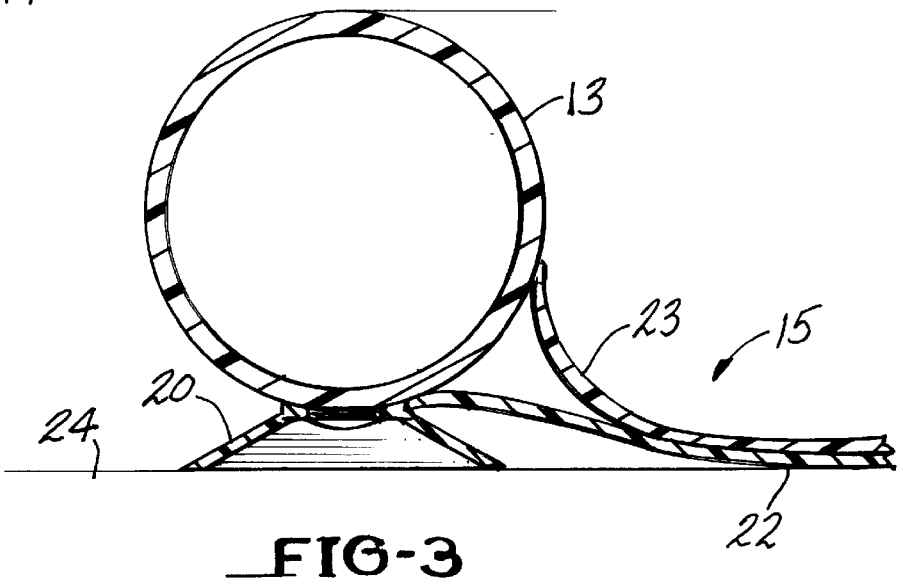
FIG. 3 is a view seen in the plane of lines 3—3 of FIG. 1.

Service portion 15, as shown in FIG. 3, comprises two sheets 22 and 23 which provide upper and lower edges. Sheet 22 is sealed to legs 13 and 14 and back portion 15 adjacent the bottoms therof and substantially tangentially thereto. Sheet 23 is sealed to sheet 22 intermediate the edges thereof and the edges are sealed to the inside surfaces of legs 12 and 13 and back portion 14. The seals of sheets 22 and 23 to legs 12 and 13 and back portion 14 are continious about the side and back edges thereof. As shown in FIG. 3, suction cup 20 has not been compressed against surface 24.

Figure 4:
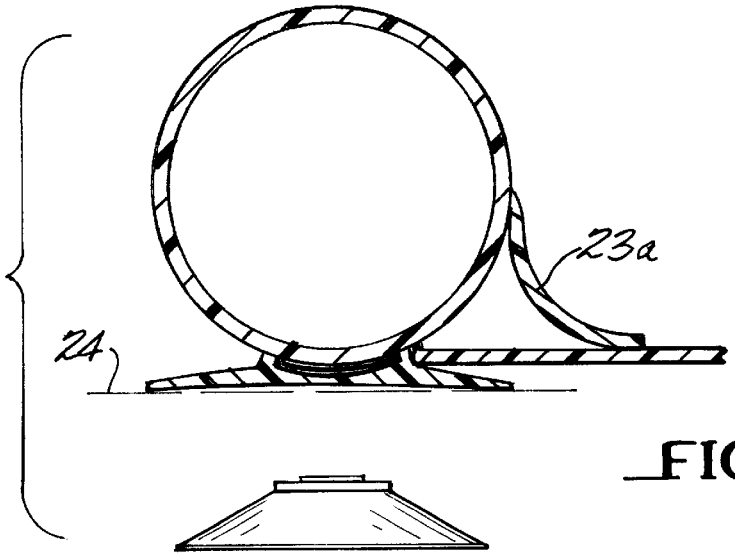
FIG. 4 is a view similar to FIG. 3 illustrating an alternate construction.

In an alternate construction sheet 23 may be replaced with a U-shaped section of material 23*a* sealed at one edge to sheet 22 and at the other edge to legs 12 and 13 and back portion 14, as shown in FIG. 4. This construction provides a barrier to any food becoming lodged beteewn member 11 and service portion 15 in the same manner as the construction of FIG. 3. The position or location of attachment of sheet 23 or section 23*a* to legs 12 and 13 and back portion 14 is such as to provide a smooth transition of service portion to tubular member 11 so that no crevice exists which might trap food therein.

In FIG. 4 suction cup 20 is shown in a compressed sealing position as when the device 10 is secured to a surface. FIG. 4 also shows a suction cup prior to attachment to tubular member 11. The suction cups are preformed and may be bonded to tubular member 11 in any suitable manner, such as by heat sealing or adhesive. The suction cups 18–21 will securely affix the device 10 to a table surface 24.

Figure 5:
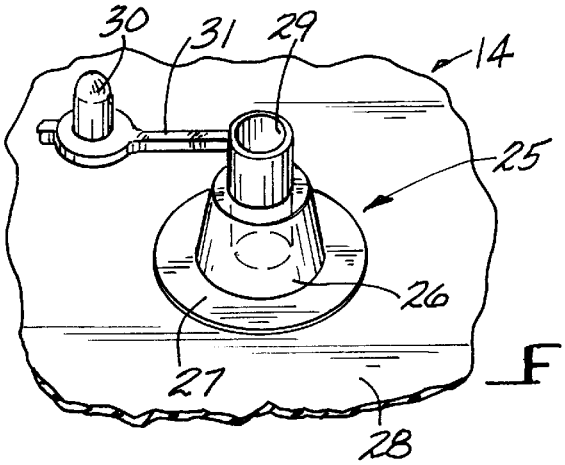
FIG. 5 is a perspectiv view of the back portion of the device of FIG. 1 showing a valving member in perspective in a first operative postion where the device is deflated.

Reference is now made to FIG. 5 which exemplifies a valve member 25 utilized to inflate and deflate the device. Valve member 25 is of well known construction including a base member 26 with a flange 27 which is sealed to wall portion 28 of back portion 15. A stem 29 extends through base 26 to the interior of tubular member 11. A valve stem closing member 30 on a strap integral with stem 29 or base 26 is a part of valve member 25. Valve member 25 is shown in an open condition in FIG. 4 when member 11 is deflated and in a closed condition in FIG. 5 when member 11 is inflated.

Figure 6:
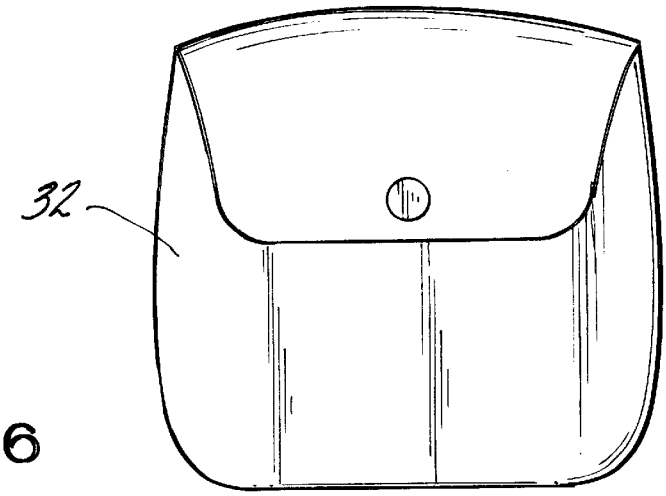
FIG. 6 is a view of a pouch for carrying and/or storing the device of FIGS. 1 and 2 when it is in a defated condition.

A pouch 32 is shown in FIG. 6 for storage of device 10 when the device is not in use.

For use, device 10 is removed from pouch 32, is inflated as by blowing up with the mouth and valve member 25 is closed. When member 11 is inflated it will tension service portion 15 between legs 12 and 13, and back portion 14 The device 10 is then affixed to a table surface 24 by the suction cups as exemplified in FIG. 4, and is ready for placement of food, or a food bearing device thereon.

Tubular member 11, by way of example only, may subtend a serving section 15 of approximately fourteen inches at the front, approximately twelve inches adjacent back section 14 and approximately ten inches deep. These dimensions are usually acceptable for a table space. The tubular portion 11 may be approximately two inches in diameter. Finger type food such as french fries, poultry nuggets, etc. may be removed from a tray as usually used in a so-called fast food establishment and placed directly on service portion 15 for a child to eat without concern that the child will spread the food all over the table, or the sanitary condition of the table.

The construction also permits the placement of a food bearing plate or other food bearing device on service section 15 and will confine any food swept , thrown or otherwise moved from a food carrier within tubular member 11. Moreover, if a child picks up any food knocked from a food service carrier, it will be from a sanitized surface, not from an ordinary table surface, which may or may not be free of bacteria.

After use, device 10 may be deflated and washed, or first rinsed if used at home and then sanitized, and stored for future use. If used outside of the home, as at a resturant, the device 10 is deflated and removed in pouch 32. Then upon arrival at home it is sanitized as is pouch 32 and stored for future use.

The device 10, particularly tubular member 11, may be formed from any type of air impervious material, such as vynil or other plastics. A vynil or other plastic material which has a smooth surface and anti-bacterial propoerties is preferred, that is one which can be cleaned in hot water and not trap any bacteria on the surface. It may be cleaned with commonly used and often carried diaper wipes.

The device may be formed in any convenient manner. For example, the tubular member 11 may have legs 13 and 14 and back portion 14 formed in tubes and joined by formed elbow connectors, and the end portions 16 and 17 then attached either by heat sealing or cement adhesive. The service portion 15 is then attached. Then the suction cups are attached as shown by heat sealing or adhesive as previously described. The technique of forming may vary dependent on the manufacturer and its forming techniques.

It may thus be seen that the objects of the invention set forth as well as those made apparent are efficiently attained. Accordingly, the appended claims are intended to cover all embodiments of the invention made apparent as well as any modifications to the disclosed embodiments of the invention and others which may occur to those skilled in the art and which do not depart from the spirit and scope of the invention.

What is claimed is:

1. A portable food service device for children arranged to be affixed to a table surface comprising a generally U-shaped tube member defined by opposed tubular legs and a tubular back portion therebetween of air impervious flexible material, said tubular legs and said tubular back portion being inflatable, valve means on one of said tubular legs and back portion for inflating and deflating said tube member, a flexible sheet attached to the bottoms of said tubular legs and back portion and defining a food portion open at the front of the device and adapted to rest on a table surface within said legs and back portion and means on the bottom of said tube member for affixing said device to a table surface.

2. The device of claim 1 wherein said food service portion is attached to said tube member at locations on the surfaces thereof so as to provide a smooth transition between said tube member and said food service portion.

3. The device of claim 1 wherein the means for affixing are a plurality of suction cups.

4. The device of claim 1 wherein said food service portion has upper and lower edges, said lower edges are attached to said tube member and said upper edges are attached to said tube member at locations on the surfaces of said tubular members so as to provide a smooth transition between said tube member and said food service portion.

* * * * *